US011479996B2

(12) United States Patent
Götzen et al.

(10) Patent No.: US 11,479,996 B2
(45) Date of Patent: Oct. 25, 2022

(54) LOCKING DEVICE FOR A MOTOR VEHICLE

(71) Applicant: Kiekert AG, Heiligenhaus (DE)

(72) Inventors: Klaus Götzen, Mülheim (DE); Christian Sturm, Krefeld (DE); Claus Töpfer, Sindelfingen (DE); Thorsten Bendel, Oberhausen (DE); Winfried Schlabs, Bochum (DE); Tim Sonnenschein, Wuppertal (DE)

(73) Assignee: Kiekert AG, Heiligenhaus (DE)

( * ) Notice: Subject to any disclaimer, the term of this patent is extended or adjusted under 35 U.S.C. 154(b) by 648 days.

(21) Appl. No.: 16/347,732

(22) PCT Filed: Nov. 7, 2017

(86) PCT No.: PCT/DE2017/100948
§ 371 (c)(1),
(2) Date: Jul. 3, 2019

(87) PCT Pub. No.: WO2018/082752
PCT Pub. Date: May 11, 2018

(65) Prior Publication Data

US 2019/0316388 A1 Oct. 17, 2019

(30) Foreign Application Priority Data

Nov. 7, 2016 (DE) ..... 10 2016 121 183.4
Nov. 7, 2016 (DE) ..... 10 2016 121 184.2
(Continued)

(51) Int. Cl.
*E05B 79/20* (2014.01)
*E05B 77/26* (2014.01)
(Continued)

(52) U.S. Cl.
CPC ..... *E05B 79/20* (2013.01); *E05B 77/26* (2013.01); *E05B 77/34* (2013.01); *E05B 81/06* (2013.01);
(Continued)

(58) Field of Classification Search
CPC ..... E05B 77/26; E05B 77/34; E05B 79/20; E05B 81/06; E05B 81/25; E05B 81/40; E05B 85/02; E05B 81/12; E05B 81/26
See application file for complete search history.

(56) References Cited

U.S. PATENT DOCUMENTS 4,683,774 A * 8/1987 Memmola ..... E05B 47/0012 74/502.4
4,702,117 A 10/1987 Tsutsumi et al.
(Continued)

FOREIGN PATENT DOCUMENTS

CN 101042176 A * 9/2007
CN 101042176 A 9/2007
(Continued)

OTHER PUBLICATIONS

Translation of First Office Action dated Aug. 4, 2020, for related Chinese Patent Application No. 2017800824022.
(Continued)

*Primary Examiner* — Kristina R Fulton
*Assistant Examiner* — James E Ignaczewski
(74) *Attorney, Agent, or Firm* — Renner, Otto, Boisselle & Sklar, LLP

(57) ABSTRACT

A method for actuating a motor vehicle lock and a locking device for a motor vehicle includes an actuating lever, a lock and a Bowden cable arranged between the actuating lever and the lock, the lock can be actuated by means of the
(Continued)

Figure 1:
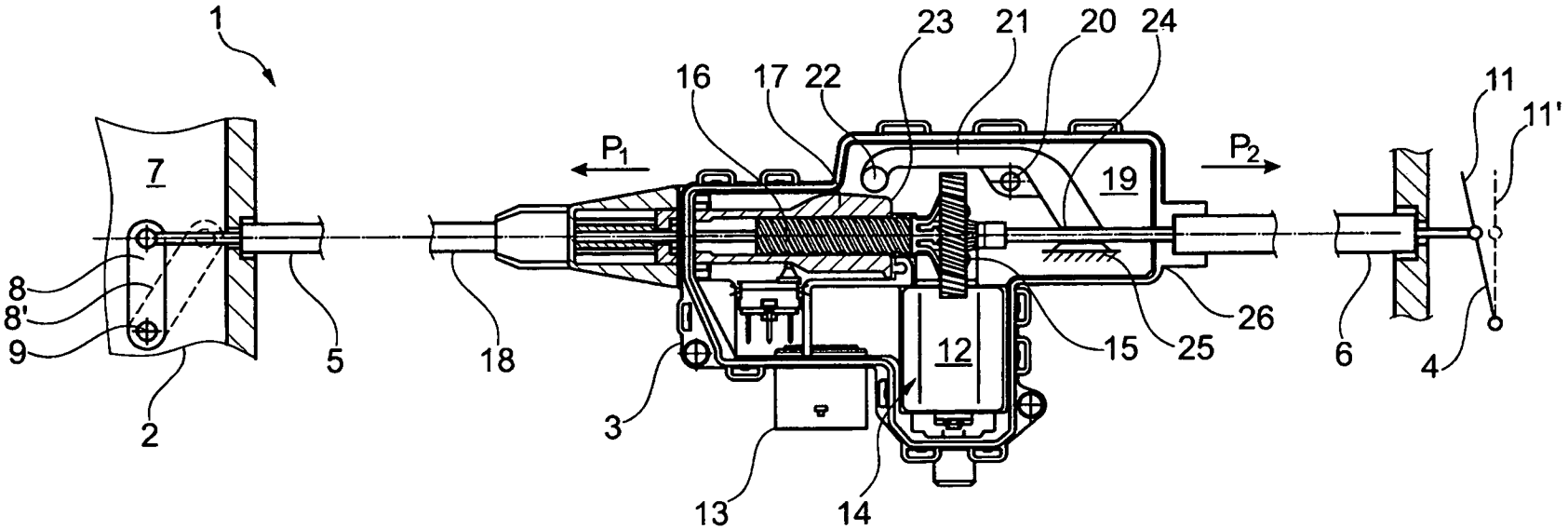

actuating lever and with the aid of the Bowden cable, and a functional unit arranged on the Bowden cable and comprising an electric drive.

11 Claims, 9 Drawing Sheets

(30) Foreign Application Priority Data

Nov. 7, 2016 (DE) ..... 10 2016 121 187.7
Nov. 7, 2016 (DE) ..... 10 2016 121 188.5

(51) Int. Cl.
*E05B 77/34* (2014.01)
*E05B 81/06* (2014.01)
*E05B 81/24* (2014.01)
*E05B 81/40* (2014.01)
*E05B 85/02* (2014.01)

(52) U.S. Cl.
CPC ..... *E05B 81/25* (2013.01); *E05B 81/40* (2013.01); *E05B 85/02* (2013.01)

(56) References Cited

U.S. PATENT DOCUMENTS 6,075,298 A * 6/2000 Maue ..... H02K 7/1166 310/83
2003/0070457 A1 4/2003 Arlt et al.
2016/0145928 A1* 5/2016 Shimizu ..... E05B 81/64 292/201

FOREIGN PATENT DOCUMENTS

| | | | | | |
|---|---|---|---|---|---|
| DE | 19710531 | A1 | | 9/1998 | |
| DE | 20216873 | U1 | | 3/2004 | |
| DE | 10046189 | B4 | | 4/2004 | |
| DE | 102007049900 | A1 | | 4/2008 | |
| DE | 102011121670 | A1 | * | 8/2012 | ..... E05B 77/04 |
| DE | 102011121670 | A1 | | 8/2012 | |
| DE | 102015104695 | A1 | | 10/2015 | |
| DE | 202016100521 | U1 | | 2/2016 | |
| DE | 202015106323 | U1 | * | 2/2017 | ..... E05B 81/40 |
| DE | 202015106323 | U1 | * | 4/2017 | ..... E05B 81/40 |
| EP | 0153978 | | | 9/1985 | |
| GB | 2184511 | A | | 6/1987 | |
| GB | 2243814 | A | | 11/1991 | |
| JP | 2004150064 | A | | 5/2004 | |
| JP | 2005194712 | A | | 7/2005 | |
| KR | 19980025976 | A | | 7/1998 | |
| WO | 97/10976 | A1 | | 3/1997 | |
| WO | WO-9710976 | A1 | * | 3/1997 | ..... B60R 25/04 |
| WO | 2012/028120 | A1 | | 3/2012 | |

OTHER PUBLICATIONS

International Search Report and Written Opinion for corresponding Patent Application No. PCT/DE2017/100948 dated May 8, 2018.

* cited by examiner

LOCKING DEVICE FOR A MOTOR VEHICLE

The invention relates to a method for actuating a motor vehicle lock and a locking device for a motor vehicle, comprising an actuating lever, a lock and a Bowden cable arranged between the actuating lever and the lock, the lock can be actuated by means of the actuating lever and with the aid of the Bowden cable, and a functional unit arranged on the Bowden cable and comprising an electric drive.

Bowden cables are used in many ways in today's motor vehicles. A Bowden cable offers the advantage that a functional element, such as a door lock, a flap lock or a hood latch can be operated remotely by means of the Bowden cable. From the ease of laying the Bowden cable to the areas that are difficult to access in the motor vehicle, the Bowden cable offers the advantage of enabling the transfer of high forces. An example of the use of a Bowden cable in a motor vehicle, for example, is disclosed in DE 100 46 189 B4. An operating device arranged inside the motor vehicle, which is formed as a swivelably accommodated actuating lever in this example, is connected to a door lock via a Bowden cable. When actuating the operating device, a lever that is swivelably accommodated in the door lock is actuated using the Bowden cable core.

Another application of a Bowden cable in a motor vehicle is disclosed in EP 0 153 978 B1. The disclosure relates to the use of a Bowden cable to actuate a hood latch, whereby the Bowden cable is firmly accommodated in the motor vehicle and the hood latch can be opened by means of an operating element arranged inside the motor vehicle. In addition to the mere function of opening the hood, the publication discloses a double lock arranged on the Bowden cable. The double lock consists of a functional unit with an electric drive. The Bowden cable is designed in a split manner and provided with a bracket that is fixed to the Bowden cable core in order to integrate the functional unit into the Bowden cable. The bracket is arranged on the Bowden cable in such a manner that the Bowden cable can be manually operated in its normal state. In order to achieve a double lock, the functional unit has a roof-tile-shaped element that can be laid over the Bowden cable core and next to the bracket, thus ensuring that the bracket can be prevented from moving. The functional unit can thus prevent the functioning of the Bowden cable, which in turn prevents the opening of the hood.

DE 197 10 531 A1 disclosed a motor vehicle door lock which can be unlocked by means of an electric drive. The pawl can be moved out of the contact area of the catch via a worm transmission and a lever mechanism. Locks that can be unlocked by means of an electric drive are also known as electric locks or e-locks. If soiling, a temperature-related incident or accident prevents the pawl from being moved out of the contact area with the catch by means of the electric drive, the publication discloses an emergency operation in which the electric drive changes its direction of rotation. The reversal of the direction of rotation of the electric motor requires a different transmission ratio to act on the lever mechanism that is in contact with the pawl. The transmission ratio for the opposite movement of the electric drive has a significantly larger reduction ratio, so that a larger loosening torque can act on the lever and thus indirectly on the pawl.

The object of the invention is to provide an improved locking device as well as a method for actuating a locking device for a motor vehicle that overcomes the disadvantages of the state of the art. Furthermore, it is the object of the invention to provide a safety device for an electrically actuated lock which, depending on the vicinity of the motor vehicle, prevents the actuation of the locking device or at least alerts the driver of the motor vehicle about an impediment. It is also the object of the invention to provide a constructive, simple and cost-effective solution for an actuating method and a locking device for a motor vehicle.

The object is solved according to the invention by the characteristics of the independent patent claims. Advantageous designs of the invention are specified in the sub-claims. It should be noted that the exemplary embodiments described hereafter are not restrictive, and there is the possibility of variations in the characteristics described in the description and sub-claims.

With regard to the locking device, the object of the invention is solved by providing a locking device for a motor vehicle, comprising an actuating lever, a lock and a Bowden cable arranged between the actuating lever and the lock, the lock can be actuated by means of the actuating lever and with the aid of the Bowden cable, and a functional unit arranged on the Bowden cable and comprising an electric drive, whereby the functional unit can prevent the Bowden cable core from moving and the movement of the Bowden cable core can be braked. The inventive design of the locking device now creates the possibility of preventing the locking device from actuating or of braking the braking of the locking device's actuation and thus sending a haptic signal to the driver of the vehicle. By sending the driver a haptic signal, that is, feedback in the form of increased resistance, the driver can be alerted to a defect or can be warned that an actuation of the locking device at this time would have an adverse effect. An impediment or a possible collision can be detected, for example, by means of a sensor in the vehicle.

According to the invention, the movement of the Bowden cable core can be braked. This means, on the one hand, that continuous braking can occur, but also that the movement of the Bowden cable core can be blocked. The functional unit has a means by which a movement of the Bowden cable core can be braked in relation to the Bowden cable cover.

In an embodiment variant of the invention, the Bowden cable core can be braked during a movement of the Bowden cable core. The functional unit is thus able to initiate a braking even if, for example, a driver has already actuated the Bowden cable core, that is, the Bowden cable core has already traveled at least part of the distance used to actuate the lever in the motor vehicle lock to be actuated. A control signal to initialize the functional unit is thus not linked to the starting point, for example, of an inside actuating lever.

It should be noted, for example, that the inside actuating lever or an outside actuating lever can be used to initialize or control the functional unit to such an effect that the functional unit can enable an electrical actuation of the lever in the lock. The functional unit can thus have at least two functions. The first function could be to brake the Bowden cable core to prevent further manual actuation of the Bowden cable core, and the second function could be the electrical opening of a lock, for example, the unlocking of a locking mechanism or the insertion of a child lock.

If the Bowden cable core can be clamped by means of the functional unit, this results in a further embodiment of the invention. The clamping of the Bowden cable core is an advantageous way of braking the Bowden cable core in relation to the Bowden cable cover. On the one hand, a braking can be easily realized by means of a lever mechanism, for example, and on the other hand, the braking speed or the braking power can be easily varied by means of a clamp. The clamping of the Bowden cable core is not linked to a specific clamping device, but any device that achieves a clamping effect is conceivable. Conceivable options include, for example, wedge-shaped or skewed levels that counteract each other, eccentric clamps, cam cleats, such as those used in boats, disks and/or shoe brakes, conical and/or cone brakes, to mention just a few examples of braking options for clamping the Bowden cable core.

In another embodiment of the invention, the functional unit has a slider, whereby the slider can be moved by means of the electric drive. A slider offers the option of providing a definable control for a braking. The slider can be moved quickly within the context of the sliding movement for one thing and can be used for definable control of a braking process through an appropriately formed slider, for example, in the form of a surface contour. Here, the slider can be driven via the electric drive, for example, via a transmission and, in particular, via a transmission and a spindle drive. In particular, the formation of the slider as part of a spindle transmission is a preferred embodiment here.

If at least one lever can be moved by means of the slider and if the Bowden cable core can be directly or indirectly braked by means of the lever, this results in a further advantageous embodiment of the invention. A compact design of a functional unit can be realized in particular by means of the interaction of a sliding element, for example, in the form of part of a spindle transmission in conjunction with a lever mechanism. A suitable bearing position of the lever can be used to adjust the braking of the Bowden cable core in an advantageous manner. Furthermore, the transmission ratio for braking can be easily adjusted through the interaction of one or more levers with a control contour on the slider. Depending on the required force for braking and/or stopping and/or blocking a movement of the Bowden cable core, the required force for braking can be designed to be adjusted.

The slider can have a control contour in an advantageous manner so that a movement of the lever can be controlled. A control contour can enable immediate braking, but can also be formed in such a manner that the Bowden cable core is continuously braked. Steep control curves are preferably used to enable the Bowden cable core to brake as quickly as possible, so that, for example, a rapid braking of the Bowden cable core is possible immediately after the initialization of the functional unit. This is especially the case if the functional unit is used, for example, in conjunction with a sensor present in the vehicle, to prevent a collision with an object and/or an object approaching the vehicle. If, for example, a cyclist approaches the motor vehicle and the driver, who is inside the motor vehicle, actuates or wants to actuate the inside actuating lever and a sensor unit in the motor vehicle recognizes that the cyclist is approaching the opening range of the door, the Bowden cable core can be braked and/or blocked by means of the braking device or the functional unit, so that a collision between the opening of the door and the cyclist can be prevented. The functional unit thus provides a safety device, whereby the opening of the lock can be prevented by means of the Bowden cable. Such a case in particular requires short reaction times, so that steep control curves on the slider or between the slider and the lever form an advantageous embodiment.

If the slider can be driven via the electric drive and by means of at least one transmission level, this results in a further embodiment of the invention. On the one hand, a transmission level enables high transmission ratios and, at the same time, it enables the realization of high forces. Particularly if the Bowden cable core is to be braked until it stops, the transmission level offers the possibility of exerting high forces on the Bowden cable core. A worm gear level in combination with a spindle transmission offers an advantageous embodiment of the invention. On the one hand, a movement of a downstream spindle transmission can be defined by means of the transmission and, at the same time, a high force ratio can be realized by the combination of worm gear transmission and spindle drive. Especially if the spindle transmission controls the slider or forms part of the slider itself, short reaction times can be realized in combination with clamping forces.

In an embodiment, the lever is part of a clamping and/or braking device. If the lever itself forms part of the clamping or braking device, a compact and constructively favorable embodiment of the functional unit can be realized. Furthermore, a low-tolerance system for braking can be provided. An immediate initialization of the lever with the slider offers the advantage of an immediate control of the braking device, so that short reaction times with low tolerances can be formed over a long service life of the functional unit or locking device.

The Bowden cable core can be formed in an advantageous manner so that it can be braked preferably at one side and even more preferably at two sides. As described above, the braking device is not restricted to a single braking system, but it is possible to form any braking devices, which can be driven by an electric drive, for the Bowden cable core in the functional unit. One-sided braking can be preferably realized by the slider acting together with a swivelably accommodated lever, whereby the lever can act directly against the Bowden cable core, whereby the Bowden cable core can be pressed by the lever, for example, against a housing wall. Alternatively, it is also conceivable that the braking device in the functional unit can be realized from a two-sided system acting on the Bowden cable core. Here, for example, clamping systems can be available as a braking device, so that the Bowden cable core can be clamped and thus braked between two movable clamping joints accommodated in the functional unit and formed, for example, as a skewed level.

The functional unit can be activated or initialized in an advantageous manner by means of a sensor signal, particularly a sensor signal that detects the vicinity of the motor vehicle. If the functional unit or locking device acts together with a sensor and/or several sensors in the motor vehicle, the functional unit can be part of a safety system of the motor vehicle. The functional unit actually offers the option of using a signal determined by a sensor as a control signal for the functional unit. If, for example, an environmental sensor detects that when a lateral door is opened, it may hit an impediment, a function, such as an inside actuation, can be braked or blocked. However, it is also possible, for example, for an outside actuating lever to be disabled by means of the functional unit in order to give the vehicle driver haptic feedback that, for example, the vehicle is not fully secured or is still in a locked state, so that opening, for example, can be prevented. The functional unit then forms part of a safety system in the motor vehicle, thus increasing the vehicle comfort and the safety of the motor vehicle.

From a process engineering point of view, the object of the invention is solved by providing a method for actuating a locking device for a motor vehicle in which a lock is actuated by means of an actuating lever and with the aid of a Bowden cable and, when actuating the actuating lever, the vicinity of the motor vehicle is monitored by at least one sensor and in which, after detecting an impediment, it can be prevented by means of a functional unit arranged on the Bowden cable. The inventive design of the method now creates the possibility of providing a comprehensive safety system for the driver, so that the comfort of the motor vehicle is increased and, at the same time, an additional safety element is available for the driver.

In an embodiment of the method, the movement of the Bowden cable core can also be braked once the actuation of the actuating lever has been initialized, that is, the actuation lever has been moved. This provides another safety feature, such as preventing the opening of a door or flap if it could lead to a collision and/or a disadvantage for the motor vehicle driver.

The invention is explained in further detail below with reference to the attached drawings based on preferred exemplary embodiments. However, the principle applies that the exemplary embodiment does not restrict the invention, but only constitutes an advantageous embodiment. The illustrated characteristics can be executed individually or in combination with further characteristics of the description, as can the patent claims be executed individually or in combination.

1st Embodiment

According to the 1st embodiment, the object of the invention is solved by providing a locking device for a motor vehicle, comprising an actuating lever, a lock and a Bowden cable arranged between the actuating lever and the lock, the lock can be actuated by means of the actuating lever and with the aid of the Bowden cable, and a functional unit arranged on the Bowden cable and comprising an electric drive, where the lock can be actuated by means of the functional unit. Actuating the lock by means of the functional unit now enables the lock to be independently locked or unlocked, for example. Thus all that is required is to trigger or adjust an initialization of a function in the lock, whereby the driver only has to directly or indirectly initialize the impulse or signal to actuate the functional unit.

Initialization can occur in a number of ways. It is conceivable, for example, that initialization occurs by means of the actuating lever, whereby the movement of the actuation lever occurs via a sensor or switching means. Furthermore, it is also conceivable, for example, that initialization occurs by means of a remote control, so that the functional unit receives a control signal for actuating the lock.

Various locks and actuation levers can be used as locking devices for a motor vehicle. The locking device can be used as a compact constructional unit, for example, in a lateral door, sliding door or in the vicinity of flaps, lids or covers. Furthermore, it is also conceivable, for example, that hood latches, auxiliary locks, such as those used in transporters, may be used. For example, an inside actuating lever or an outside actuating lever, such as a door handle, can be used as an actuating lever. However, it is also conceivable that sensitive means such as touch-sensitive switches and/or pushbuttons or buttons may be used to initialize the functional unit.

The locking device is used where a Bowden cable is employed between the actuating lever and a lock. The Bowden cable consists of a Bowden cable cover and a Bowden cable core, where the Bowden cable cover is separated and the Bowden cable core is continuously formed. This ensures manual actuation at all times, whereby the Bowden cable core, for example, uses the actuating lever at all times, that is, even when the motor vehicle is switched off. The Bowden cable core is inserted into the functional unit, whereby the Bowden cable cover restricts the functional unit on both sides or the Bowden cable cover is accommodated and/or accommodated in a longitudinally movable manner in the functional unit. The Bowden cable actively connects the actuating lever to the lock, so that a normal actuation of the lock is possible, for example, via a swiveling of the actuation lever.

The functional unit includes an electric drive which, after initializing or receiving a control signal, moves the functional unit in such a manner that the lock can be actuated by means of the functional unit. The electric drive is preferably an electric motor. Electric motors are advantageous because they are quiet, available in a wide variety and can be easily used in a motor vehicle. Thus if the lock itself is actuated by means of the functional unit, the use of the locking device is made easier by the invention.

In an embodiment of the invention, a relative movement can be produced between a Bowden cable core and at least one part of a Bowden cable cover by means of the functional unit. If at least one part of a Bowden cable cover is actuated by means of the functional unit, a relative movement occurs between the Bowden cable core and the Bowden cable cover. The actuating lever itself is usually in a test position, that is, the actuating lever is preferably fitted in a spring-tensioned manner against a stop. A lever, slider or actuating means is arranged in the lock itself and can be actuated by means of the Bowden cable core. If, due to the control of the functional unit, at least one part, and preferably the part of the Bowden cable cover between the functional unit and the lock, is moved by means of the functional unit, this leads to the moving, swiveling and/or actuating of the movable lever arranged in the lock. As a result of the relative movement between the Bowden cable cover and the Bowden cable core, a lever can be actuated in the lock. This manner of initiating a movement in the lock thus provides a system which can be described, for example, as an electric opening module, which makes it easier to use a locking device.

Preference is given to the part of the Bowden cable cover between the lock and the functional unit that is controlled via the functional unit, whereby the relative position of the Bowden cable core is moved to the Bowden cable cover. It is, of course, also conceivable that the relative position between the functional unit and the actuating lever is moved by means of the functional unit, which ultimately also leads to the actuation of the movable lever arranged in the lock. The Bowden cable itself finds a fixed bearing in the lock and in the area of the actuating lever with the Bowden cable cover, that is, the Bowden cable cover can, for example, be accommodated in a fixed manner in the housing of the lock and can be fixed in the area of the actuating lever, for example, by means of a screw. For actuation, it must be possible to actuate the Bowden cable core through the Bowden cable cover and the functional unit. This is particularly necessary because the manual use of the lock via the actuating lever must be ensured at all times in order, for example, to enable an actuation of the lock via a manual actuation of the actuating lever in the event of a power drop. The functional unit thus does not change the position of the Bowden cable itself in the motor vehicle, but changes the relative length of the Bowden cable cover in relation to the Bowden cable core. An extension of the Bowden cable cover results in the Bowden cable core being drawn into the Bowden cable cover, ultimately making it possible to actuate the lock.

Thus the functional unit can also be described as a Bowden cable extension unit. By means of the functional unit, the relative length of the Bowden cable cover can be varied and enlarged which, in terms of the fixed end positions of the Bowden cable cover in the area of the actuating lever and the lock, results in a shortening of the Bowden cable core ends protruding from the Bowden cable cover, whereby a shortening of the free end of the Bowden cable core, which protrudes from the Bowden cable cover, ensures that a movement can be achieved in the lock by means of the Bowden cable core.

In another embodiment of the invention, the functional unit has at least one guide, particularly a longitudinally movable guide, for at least one part of a Bowden cable cover. A guide in the functional unit ensures a high level of functional reliability for the locking device. If the Bowden cable cover is moved by the functional unit, it must be ensured at all times that the Bowden cable cover is safely guided so that, on the one hand, easy actuation can be achieved by means of the functional unit and, on the other hand, functional reliability can be ensured at all times. A housing of the functional unit may have in an advantageous manner, for example, a longitudinal guide in which the Bowden cable cover can be guided longitudinally. It is, of course, also conceivable that more than one guide is provided in the functional unit, with the number of guides determined by the number of Bowden cable cores and the related Bowden cable covers. It is thus also conceivable according to the invention that a lock and an auxiliary lock, such as those used for large transporter doors, can be actuated by means of the functional unit. It is conceivable on the one hand, for example, that one works with an actuating lever, but that the Bowden cable core splits, so that a lock and at least one auxiliary lock can be actuated with a functional unit. Of course, it is also conceivable that several functional units interact, whereby the first functional unit can interact with, for example, the lock or main lock and another functional unit with the auxiliary lock.

If the functional unit has a slider, whereby the slider can be moved by means of the electric drive, this results in a further embodiment of the invention. A relative movement between the Bowden cable cover and the Bowden cable core can be very easily produced by means of a sliding element arranged in the functional unit. If, for example, the slider is attached to the Bowden cable cover in an unactuated position of the functional unit and the Bowden cable core is guided through the slider, the slider can be fully attached to the Bowden cable cover. The sliding element or slider can then exert a load that is distributed as evenly as possible, but is also high on the Bowden cable cover, which ensures a high level of functional reliability. Furthermore, a sliding element or slider provides the option of very good longitudinal storage in the functional unit, so that a high level of functional reliability can be ensured every time the functional unit is actuated and a continuously consistent force can also be exerted on the Bowden cable cover or the Bowden cable core.

There is a further advantage if the slider can be moved by means of a transmission level. The use of a transmission level offers the advantage that, on the one hand, high forces can be achieved and, on the other hand, an even movement at a definable speed can be produced.

It is especially preferred if the slider can be moved by means of a spindle drive. A spindle drive can be used to easily achieve left movements, which can also be adjusted very precisely since, depending on the slope of the spindle thread, the displacement speed and the force to be transmitted can be defined and adjusted. In particular, the combination of an electric motor and a worm gear in combination with a spindle drive for the slider offers an advantageous embodiment in order to achieve a constructively favorable embodiment in terms of the design of the functional unit.

There is a further embodiment of the invention if the parts of the Bowden cable cover can be expanded by means of the functional unit, and can be moved especially in opposite directions. If the functional unit is constructed in such a manner that it is possible to move the parts of the Bowden cable cover associated with the functional unit, this enables very fast reaction times to be realized since two areas are available in the functional unit in order to create a relative movement between the Bowden cable cover and Bowden cable core. The functional time can, for example, be halved by a two-sided movement of the Bowden cable cover in relation to the Bowden cable core, for example, with the same design of the transmission level and spindle drive. This leads to a further increase in ease of usability and thus to an increase in comfort.

In another embodiment of the invention, the functional unit has fixed storage on one side for the first part of a Bowden cable cover, where the functional unit on an opposite side has a guide for the second part of the Bowden cable cover, and the second part of the Bowden cable cover can be moved relative to the first part of the Bowden cable cover by means of the slider. This preferred embodiment of the invention offers the advantage of a compact design and a high degree of functional reliability. On the one hand, there is the possibility of fixing the functional unit by a fixed connection with the Bowden cable cover of the first part of the Bowden cable, and this fixed rearrangement also offers the possibility of a safe guiding through of the Bowden cable core.

If the actuating lever has a detection means, particularly a microswitch and/or a sensor, to detect an actuation of the actuating lever, whereby the functional unit can be controlled by the detection means, this results in a further embodiment of the invention. The use of a detection means, that is, a means of detecting an actuation of the actuating lever, enables a control signal to be sent to the functional unit, so that the functional unit can be initialized. The detection means may be a microswitch or also, for example, a touch-sensitive sensor, so that the actuating lever can only actuate until the detection means has detected the actuation of the actuating lever and thus a control signal can be issued to the functional unit, whereby the functional unit actuates the lock. This design, and in particular the functional unit, makes it easier to use and increases comfort for the driver of the motor vehicle. The driver only has to initialize, whereby the functional unit takes over the actual movement in the lock.

From a process engineering point of view, the object of the invention is solved by providing a method for actuating a locking device for a motor vehicle in which a lock is actuated by means of an actuating lever, and the actuation of the actuating lever is detected by a detection means which in turn generates a signal, and the signal controls a functional unit in such a manner that a lock is opened by a movement that can be achieved in the functional unit. The method of actuating a locking device significantly increases the comfort in the motor vehicle, since the driver of the motor vehicle only has to actuate the detection means, such as a switch with the actuating lever, in order to open and/or trigger an actuating movement in the lock. This provides an opening module with which a lock in the motor vehicle can be very easily used with great comfort.

2nd Embodiment

The object of the invention is solved according to the 2nd embodiment by providing an actuator for a motor vehicle that has a housing, a mobile actuating means that can be moved in and out of the housing at least area by area, whereby the actuating means can be moved through an opening in the housing and at least a seal enclosing the opening, whereby the opening can be sealed by means of a ring-shaped sealing cap that encompasses the actuating means and interacts with the housing, whereby the actuating means can be moved through the sealing cap. The inventive formation of the actuator now creates the possibility of achieving a comprehensive, continuous sealing level between the actuating means and the housing. Such sealing effectively and permanently prevents the penetration of environmental influences such as moisture, dust and/or impurities. In doing so, a ring-shaped sealing cap offers the possibility of an identical surrounding contact force between the sealing means or the sealing cap and the housing. At the same time, the sealing cap offers the possibility of storing the actuating means on the one hand, and of keeping it sealed on the other hand.

An actuating means according to the invention includes an electric drive, which preferably interacts with at least one transmission, as well as an electrical contact, for example, in the form of a plug socket. The actuating means can still include a spindle drive that interacts with the transmission. At least one transmission part can be formed in one piece with the spindle drive. A sliding element is accommodated in an advantageous manner in the housing of the actuator and can interact with elastic end stops. Due to the interaction between an electric drive motor, transmission and/or spindle drive, it is possible to move the actuating means through an opening in the case. The movement includes a linear actuating movement, so that the actuating means can be moved in and out of the housing. The actuating means can include any application in which movement can be realized or controlled in the motor vehicle. Furthermore, the actuating means itself can interact in turn with another component, for example, to enable a swiveling and/or moving of the component.

The actuating means is mounted through an opening in the housing of the actuator. The housing is preferably constructed in a multi-part and, in particular, two-part manner, whereby a housing and a housing cover are preferably formed. The opening is preferably located in the housing. The seal encloses the opening completely, so that the seal is continuous. The seal is preferably ring-shaped, that is, with a uniform diameter, and interacts with a sealing cap. To enable improved sealing of the actuator, the sealing cap has a ring-shaped form, at least in the area of the opening, so that a seamless and uniform contact surface can be achieved between the seal and the sealing cap. The housing is designed to be closed to the seal, so that the sealing cap is also ring-shaped and, for example, can be placed in a form-fitting manner on the housing. A form-fitting connection between the sealing cap and the housing enables the easy joining and connecting of the sealing cap to the housing. The sealing cap has at least an accommodation area and a joining opening for each area, so that the actuating means can be stored and/or can be managed by means of the sealing cap. According to the invention, the interaction of the sealing cap and housing can be used to achieve a secure seal between the sealing cap and the housing, so that the interior of the housing or actuator can be protected from environmental influences.

In an embodiment of the invention, the seal is fully accommodated in the housing. The accommodation of the seal directly in the housing enables, for example, the insertion of the seal before the sealing cap. The seal can be held securely in its exact position in the housing by a complete accommodation. A secure and defined accommodation of the seal in the housing provides the highest level of security in relation to the seal of the housing. However, it is also possible, in an alternative embodiment, that the seal can be fully held in a form-fitting manner in the sealing cap.

The sealing cap can be connected in an advantageous manner by means of a bayonet-type lock bar that interacts with the housing. To connect the sealing cap with the housing, it has proved advantageous if there is a bayonet fitting on the housing and a corresponding opening on the sealing cap. For this purpose, the housing can have an extension of the opening arranged in the housing, through which the lock bars formed on the sealing cap can be guided. By twisting the sealing cap, the lock bars engage behind the housing and thus secure the position and location of the sealing cap. Two lock bars are preferably arranged on the sealing cap, which cooperate with two extensions in the opening. However, it is also conceivable that three or more lock bars are arranged on the sealing cap, which cooperate with a corresponding contour or opening in the housing. A bayonet fitting also offers the advantage of enabling easy mounting and, at the same time, secure storage of the actuating means.

If the actuating means has at least one accommodation area, particularly a ring nut, to accommodate a sealant, this results in a further embodiment of the invention. The actuating means extends through the sealing cap. The actuating means has a ring nut for sealing between the actuating means and the sealing cap and/or housing. In terms of the actuator, the actuating means is accommodated in such a manner that it can be moved in and out of the housing of the actuator. In order to seal the movement of the actuating means, a sealant can be provided that engages with the ring nut of the actuating means and can be mounted on the sealing cap and/or the housing. Preferably, this is an elastic sealant which is so elastic that the movement of the actuating means is compensable, that is, that the sealant remains engaged with the actuating means during the movement of the actuating means. A ring nut offers an extremely secure and precise accommodation area for a sealant. The ring nut provides a form-fitting accommodation for the sealant.

In a further advantageous design of the invention, the sealing cap has at least one accommodation area, particularly a ring nut, to accommodate a sealant. If the sealant is mounted directly on the sealing cap, an extremely favorable accommodation area is provided for the sealant, since the sealing cap is arranged in the immediate vicinity of the actuating means on the housing of the actuator. The sealant can thus be formed as little as possible in terms of dimensions. The local proximity of the sealing cap on the actuating means offers the first advantage of a constructively favorable design and also offers the advantage of enabling a secure and defined storage or accommodation area for the sealant. The sealant can thus be positioned in the sealing cap, whereas the accommodation of the sealant on the actuating means can be moved. The sealant can thus have a fixed bearing and a movable bearing. A ring nut offers a favorable form-fitting accommodation option for the sealant, since sealants are preferably formed from elastomeric plastics, preferably thermoplastic rubbers.

If the sealant is durable in at least one accommodation area of the actuating means and/or the sealing cap, whereby the sealant is formed in such a manner that the sealant can follow a movement of the actuating means, this results in an advantageous embodiment of the invention. If the sealant is held in an accommodation area of the actuating means and in an accommodation area of the sealing cap, a movement of the actuating means can be securely sealed. The sealing cap thus has a variety of functions. First, the sealing cap is used to guide or accommodate the actuating means, so that the actuating means can perform a definable movement. Secondly, the sealing cap has the sealing function, that is, the cap seals the housing against environmental influences. Thirdly, the cap has the function of enabling a secure fixing on the housing, preferably using a bayonet-like locking technique. Fourthly, the sealing cap serves as accommodation for a sealant for the actuating means. The sealing cap is thus a multifunctional component of the actuator.

In one preferred embodiment of the invention, there is an advantage if the sealant is a bellows. A bellows hereby offers the advantage that the relative movement between the actuating means and the sealing cap is compensable. Preference is given to a bellows in the form of a thermoplastic rubber component, which can be accommodated in the accommodation of the actuating means on the one hand and, on the other hand, in the accommodation area of the sealing means or sealing cap. The bellows can be fixed in a ring nut of the sealing cap. Furthermore, the sealing cap may have bars, for example, that are arranged to surround the sealing cap, so that the sealing cap can be easily fixed to the housing. The bars are preferably extensive and are arranged at regular intervals along the circumference of the sealing cap, so that, for example, the sealing cap can be manually mounted.

If the actuating means has a bearing, a sealing bearing, for a Bowden cable, this results in an embodiment of the actuator. The actuator is used in a preferred embodiment as an actuating means. In this case, actuating means signifies that a relative movement can be achieved between a Bowden cable core and the Bowden cable cover. If there is talk of a rearrangement of the Bowden cable according to the invention, this preferably means the storage or fixing of the Bowden cable cover in the actuating means. The Bowden cable cover is firmly connected to the actuating means or connected to the actuating means in such a manner that the Bowden cable cover can be moved back and forth relative to the Bowden cable core. Movable back and forth here means that a fixed firmly bonded, non-positive or form-fitting connection is established between the Bowden cable cover and the actuating means, so that the Bowden cable cover can be moved in and out of the actuator. Here, the movement of the Bowden cable cover is independent of the Bowden cable core. This means that an actuating movement of a lever attached to the Bowden cable core is possible by means of the Bowden cable cover. The actuator thus can also be described as an actuating module or as an opening module in a special embodiment.

Here, an embodiment of a Bowden cable core of a Bowden cable can be freely guided through the actuator. The free guiding of the Bowden cable core through the actuator enables the initiation of a movement of a lever or slider connected to the Bowden cable core by the actuating means and the Bowden cable cover firmly connected to the actuating means. If the Bowden cable core can be freely guided through the actuator and is firmly connected, for example, to a lever of a lock, the lever can be moved by the relative movement of the Bowden cable cover. In this case, the actuator acts as an actuating means and can serve as an opening module, for example, if the lever arranged in the lock can, for example, be directly or indirectly used to unlock a locking mechanism.

There is a further advantageous embodiment of the invention if the housing has a cross-sectional shape which changes along the actuating means, whereby a height of the housing continuously increases with respect to the actuating means, so that an inclined level, especially for supporting a housing cover, can be produced. We can refer to an inclined level when, starting from a level that results in an intended flat surface along a Bowden cable core, from which the housing increases towards the sealing cap, so that a reference, for example, to a flat surface towards a connected Bowden cable results in a level, which changes in height from the level of the Bowden cable towards the sealing cap or is at an angle to the level of the Bowden cable. By forming an inclined level, it is possible, on the one hand, to provide a large sealing surface for the sealing cap and, on the other hand, to provide a plane level for a seal between the housing and housing cover. A plane level results in the advantage that only a plane level is to be sealed between the cover and housing. The height of the housing preferably increases from a first connection side of a Bowden cable through the housing to an outgoing end of the Bowden cable or through the Bowden cable core to the sealing cap, which accommodates the further part of the Bowden cable cover.

3rd Embodiment

The object of the invention is solved according to the 3rd embodiment by providing an actuator for a motor vehicle, which has a housing, particularly a housing shell and at least one housing cover, an electric drive, whereby an actuating means can be moved in and out of the housing via the electric drive and the actuating means can be moved at least by a spindle drive, whereby at least a storage of the spindle can be inserted into a recess of the housing. Storing the spindle in a recess of the housing now creates the option of storing the spindle drive of the actuator safely and in a defined manner and of thus increasing the operational safety of the actuator. Operational safety is increased by the fact that a defined storage can be achieved for the spindle through the recess in the housing and preferably in the housing shell. A recess in the housing can be designed very accurately, whereas a bearing point of at least two housing parts depends on the housing tolerances with respect to each other and/or the connectivities of the housing parts. Furthermore, the one-piece recess formed in the housing is advantageous in that the recess or accommodation area in the housing, which can be formed in a defined manner, enables the tolerances for the bearing point or accommodation area to be very precisely designed, which in turn leads to a reproducible tolerance in the bearing point. Tolerances that must be precisely observed in the bearing point increase the ease of movement and are independent of, for example, connectivities between housing parts.

An actuator according to the invention can be used in various applications. Thus the application examples described at the start are of course possible, and the lock bars or levers that are moved via an actuating means of an actuator can perform other functions. With the lock bar, for example, the actuator can lock a fuel filler flap, storage compartment or plug to secure a vehicle, for example, or to secure a charging process, for example, during a charging of a motor vehicle. An actuator according to the invention can also be used for integration into a Bowden cable in order to produce a relative movement between a Bowden cable core and a Bowden cable cover. Here, a Bowden cable core reaches through the actuator, whereby one end of a Bowden cable cover can be fixed, for example, in the housing of the actuator and another end of the Bowden cable is connected to the actuating means. A relative movement can then be achieved between the Bowden cable core and the Bowden cable cover through the movement of the actuating means in the actuator. The application areas of an actuator are thus numerous and cannot be conclusively listed.

The housing preferably has a housing shell in which, for example, an electric drive, one or more microswitches, a plug socket and/or a storage for an actuating means can be integrated or accommodated. It is also conceivable, of course, that the housing shell is formed in a multi-part manner and interacts with a housing cover. Furthermore, the housing cover can also be designed in a multi-part manner if, for example, its production or mounting requires it.

The actuating means interacts with a spindle drive, whereby a spindle nut can be part of the actuating means that can be guided on the spindle. The spindle drive itself can in turn be formed in one piece, at least in relation to the spindle, with a transmission level or worm gear. The worm gear can then interact with a worm which, for example, is accommodated directly on a motor shaft of the electric drive.

At least one bearing point of the spindle or the combination of spindle and worm gear is stored in an advantageous manner in a recess of the housing. The housing, and particularly the housing shell, are formed in such a manner that after an insertion and/or the spindle and the actuating means, the spindle can be moved axially. In other words, after inserting the spindle into the housing shell, an axial movement of the spindle is possible in order to insert or introduce the storage of the spindle into the recess. At the same time, by moving the spindle into the recess, the spindle can be moved to its end position, so that upon reaching the end position in the recess in the bearing point, the worm gear and the worm are in the optimal engagement ratio. This highlights another advantage of the storage of the spindle in the recess, namely that the engagement ratios between the worm and the worm gear can be stabilized by a fixed storage of the spindle in the housing. Thus it is possible to ensure a safe interaction between the worm and worm gear, even at the highest loads of the actuator.

In an advantageous embodiment of the invention, the spindle has two storages in the housing, with at least one storage having a bearing sleeve. A bearing sleeve offers the advantage of making an additional safety device possible for the precise storage of the spindle in the actuator. If a play arises between the spindle and recess due to production tolerances, a separately produced bearing sleeve may have higher production tolerances and may thus stabilize the bearing points. This offers an advantage especially when the spindle and/or the housing are made of plastic.

It is also advantageous if at least one bearing sleeve can be attached to the spindle, that is, arranged on the spindle in a torsion-resistant manner. The fixing of the bearing sleeve to the spindle enables the bearing sleeve to be mounted in the housing before mounting the spindle. In doing so, it is possible to realize a precise fixing of the bearing sleeve in relation to the spindle, which in turn enables the elimination of production tolerances of the spindle, which is mostly made of plastic. Preferably, the bearing sleeve is firmly connected to the spindle. Here, the bearing sleeve can be connected to the spindle in a non-positive, form-fitting and/or firmly bonded manner. Regardless of the fixing method, the bearing sleeve is torsion-resistant, that is, connected in a fixed manner to the spindle, so that the bearing sleeve rotates with the spindle in the actuator.

If the bearing sleeve is made from a material that has a higher strength than the material of the spindle and/or the housing, this results in a further advantageous embodiment of the invention. The spindle and the housing of the actuator are preferably made of a plastic. The bearing sleeve, on the other hand, has a material that has a higher strength value than the spindle and/or the housing. The bearing sleeve is preferably made of a metallic material, especially a steel. The selection of a metallic material enables the provision of a secure positioning with high operational safety and a low friction value, thereby increasing operational safety on the one hand and, on the other hand, the ease of movement of the spindle in the actuator.

The bearing sleeve is at least designed area by area in an advantageous manner and in a further embodiment of the invention so that the bearing sleeve has at least a tapering diameter area by area. The conical, or at least area by area conical formation of the bearing sleeve can, on the one hand, achieve easier mounting of the spindle in the housing, whereby the conical area can, for example, serve as a guide aid. Furthermore, a geometric design of the bearing sleeve can stabilize the positioning of the spindle in the housing. If, for example, the bearing sleeve and/or the recess is conically formed, a precise positioning of the spindle can be established in relation to the actuating means as well as to a worm gear.

If the bearing sleeve tapers in the axial direction of the spindle towards a contact surface of the spindle in the housing in diameter, this results in a further embodiment of the invention. By tapering the bearing sleeve, the contact surface of the bearing sleeve can be reduced in the axial direction, that is, the contact surface at the axial ends of the spindle against the housing. A reduced contact surface leads in turn to the reduction of the friction value between the bearing points and especially in the area of the bearing sleeve. This increases the ease of movement of the spindle. The bearing sleeve can have, in an advantageous manner, a first cylindrical area across the spindle and a second tapering area in the diameter, which protrudes beyond the spindle. If, for example, an end of the spindle is cylindrically formed, the bearing sleeve with a cylindrical area can be put directly over the spindle and can be connected to the spindle. An area of the bearing sleeve that protrudes beyond the spindle end has a tapering diameter, so that there is an end of the bearing sleeve that can be described as pointed. The tapering end that protrudes beyond the spindle can also be called a conical extension. There is a smaller diameter at the axial end of the bearing sleeve, which is in contact with the contact surface in the housing, so that, on the one hand, a stabilization of the spindle in the housing is possible and, on the other hand, a minimum contact surface is achievable if the sleeve is attached to the axial contact surfaces.

In an advantageous embodiment, the spindle or the actuating means driven by the spindle serves as a sliding element, whereby a Bowden cable cover can be moved by means of the sliding element. If the spindle and the bearing sleeve have a passage opening for a Bowden cable core, a relative movement between the Bowden cable core and the Bowden cable cover can be produced in an advantageous manner. The spindle, actuating means and bearing sleeve have a passage opening, so that the Bowden cable core can be freely moved through the actuator. The actuator thus serves in this embodiment to create a relative movement between the Bowden cable cover and the Bowden cable core. Here, the actuator is integrated into the Bowden cable whereby, for example, part of the Bowden cable cover can be firmly connected to the actuator, for example, in the form of a press fit, and a second part of the Bowden cable cover can be firmly connected to the actuating means of the actuator, so that when the actuating means are moved, the two parts of the Bowden cable cover can be moved relative to each other.

If a stop surface of at least one bearing point or storage of the spindle is formed at least area by area from a housing cover, this results in a further embodiment of the invention. The housing cover can fix the spindle on the one hand and, on the other hand, provide the stop surface for the spindle or the bearing sleeve. Here, for example, the housing cover can engage the actuating means in a recess and thus fix the spindle accommodated inside the actuating means in the housing of the actuator. In this exemplary embodiment also, a tapering bearing sleeve can interact in an advantageous manner with the housing cover, where the small diameter of the tapering bearing point or bearing sleeve is attached only with the smallest possible diameter to the stop area in the housing cover. The operational safety and ease of movement are improved by the means according to the invention.

Figure 2:
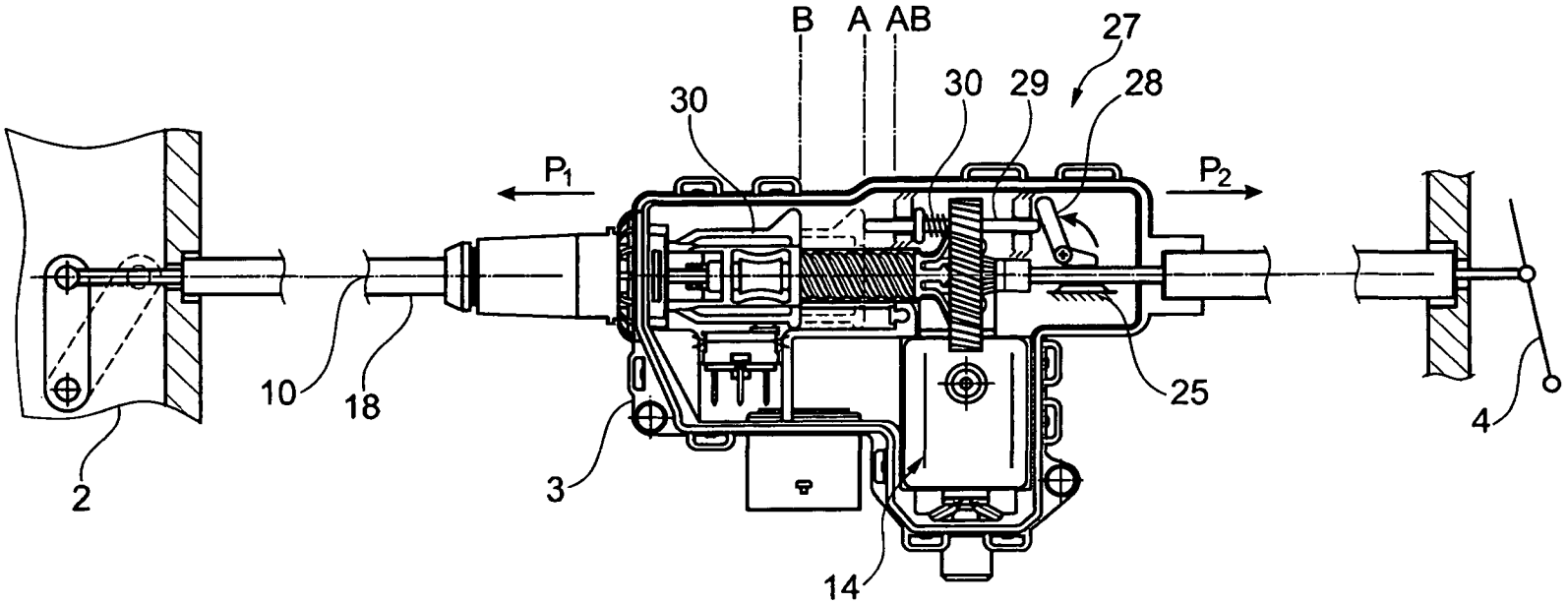
Figure 3:
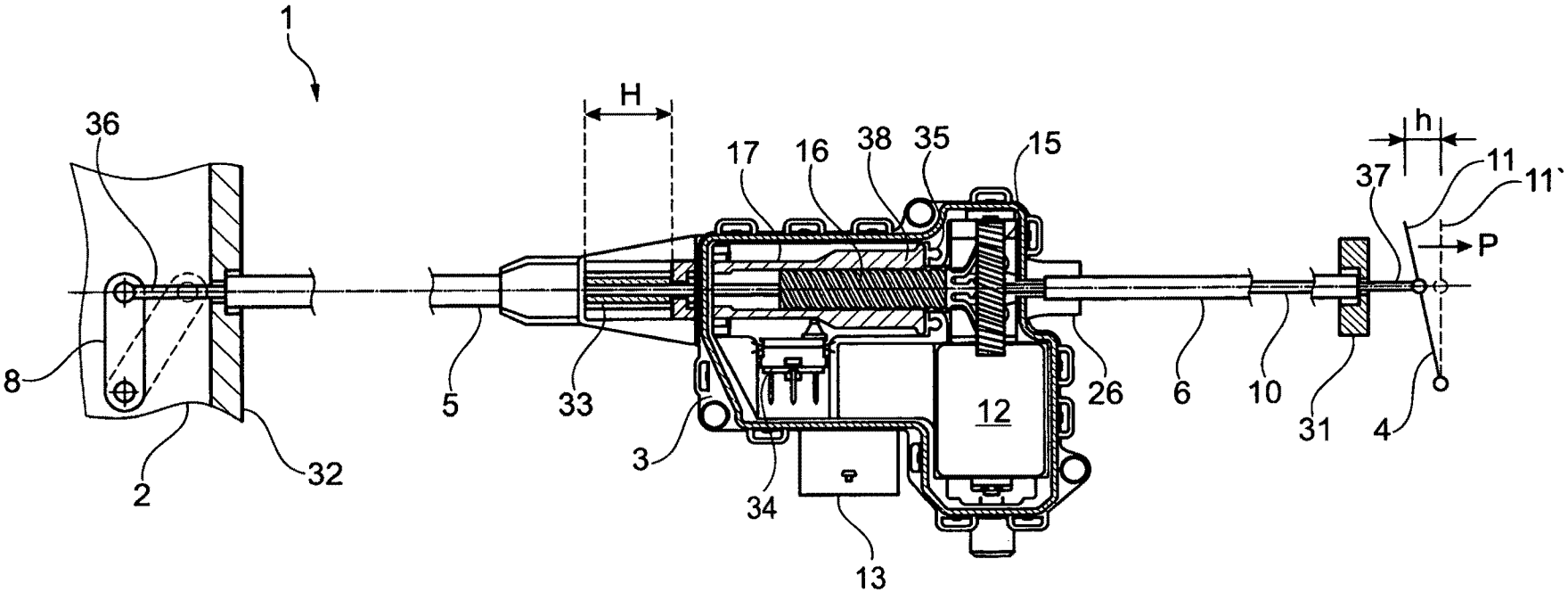
Figure 5:
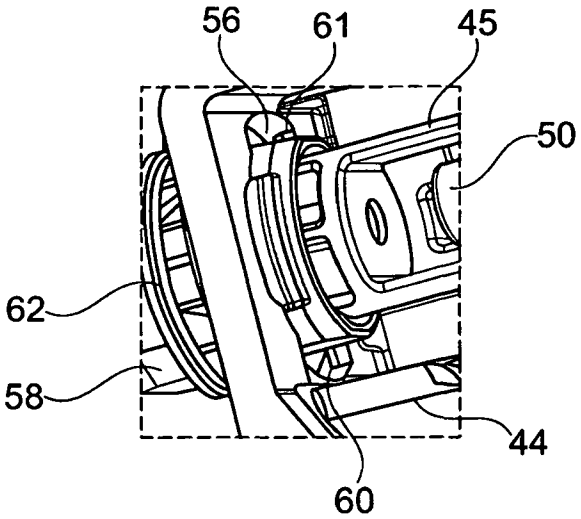
Figure 4:
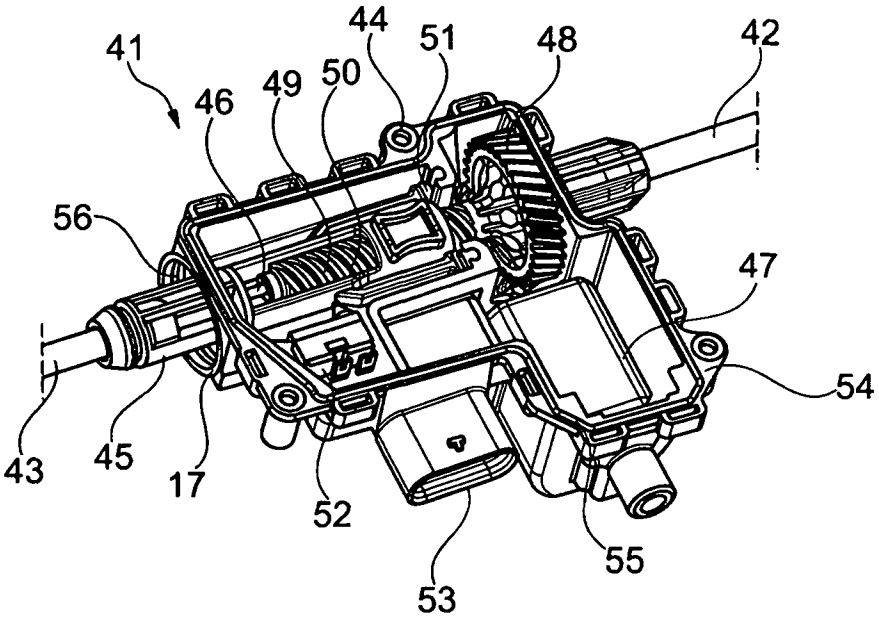
Figure 7:
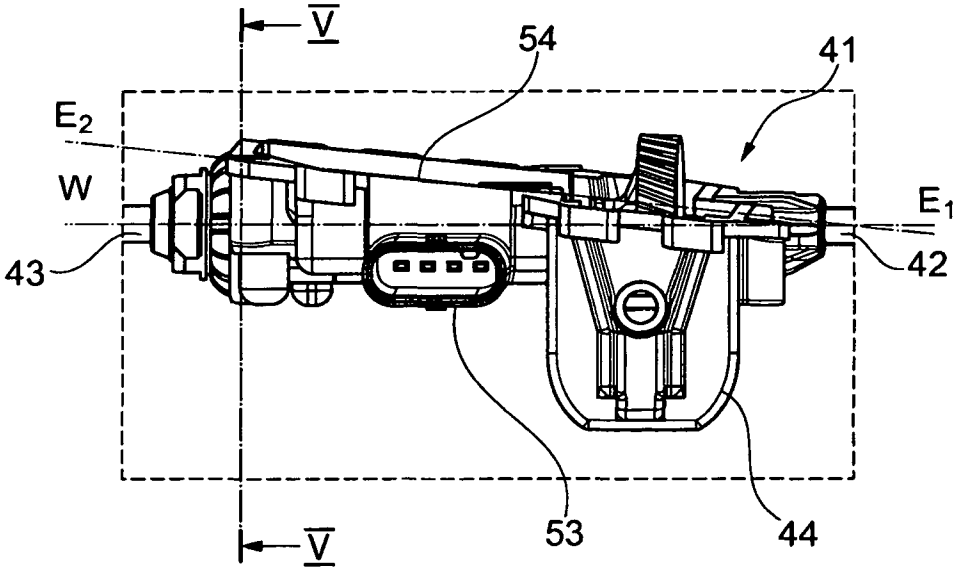
Figure 6:
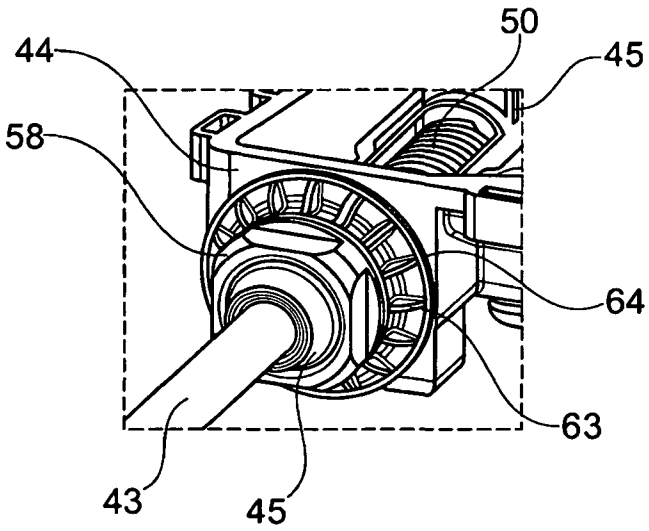
Figure 9:
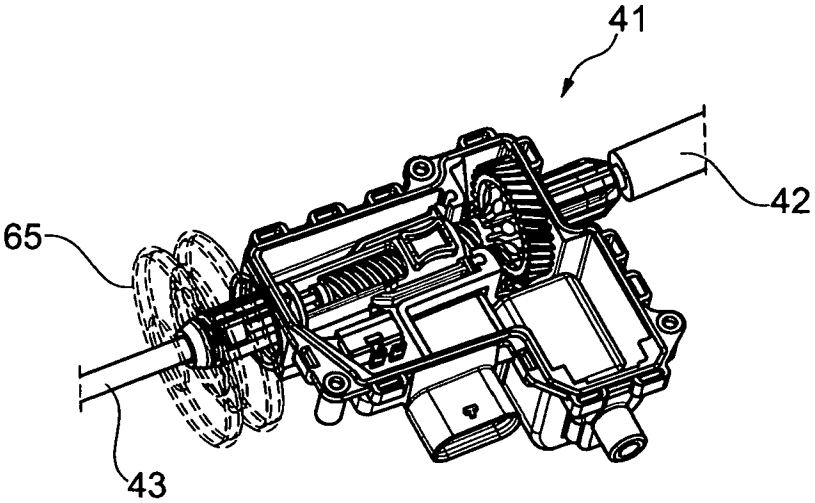
Figure 8:
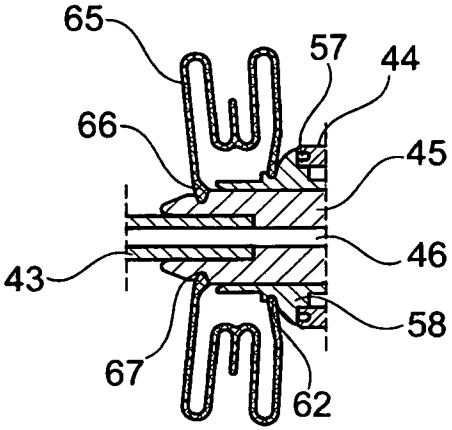

The following are shown:

FIG. 1 a side view of a locking device for a motor vehicle with a lock, a functional unit and an exemplary indicated location of an actuating lever; and FIG. 2 a basic illustration of a locking device consisting of a lock, an alternative embodiment of a functional unit and a basically illustrated actuating lever, FIG. 3 a basic illustration of an arrangement of a locking device with an actuating lever, a Bowden cable, a functional unit and a lock, FIG. 4 a three-dimensional view of an actuator without a housing cover and without a sealing cap as part of an actuating module inserted into a Bowden cable, FIG. 5 a detailed view of an opening in the housing of the actuator with a sealing cap, which is connected to the housing by means of a bayonet fitting, FIG. 6 another view of the sealing cap according to FIG. 2 in a top view of the housing with an actuating means guided in the sealing cap and a Bowden cable cover attached to the actuating means, FIG. 7 a side view of the actuator without a housing cover with a sealing cap and a Bowden cable cover attached to the actuating means, FIG. 8 a sectional view along the line V-V from FIG. 4 with an arrangement of the sealing cap in the housing with a bellows arranged on the sealing cap and the actuating means, FIG. 9 a three-dimensional view of the actuator with a bellows.

Figure 11:
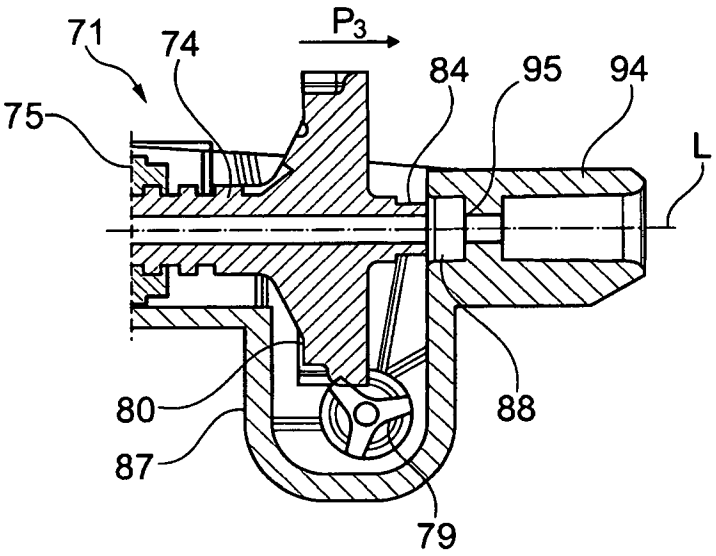
Figure 10:
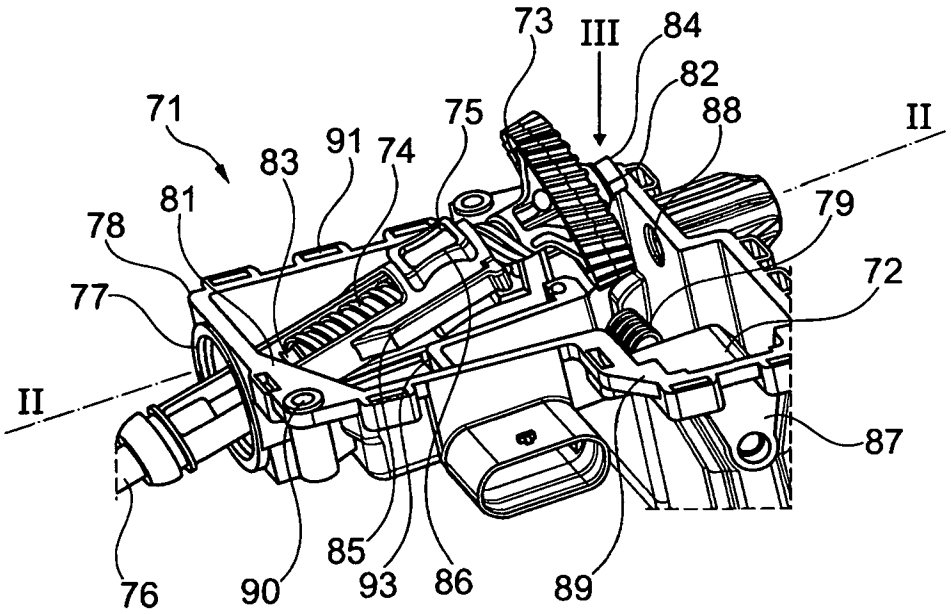
Figure 12:
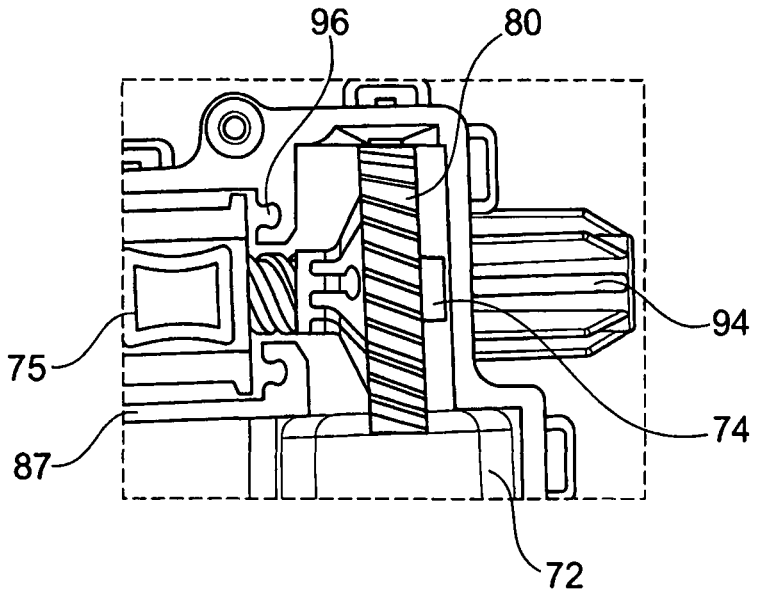
Figure 13:
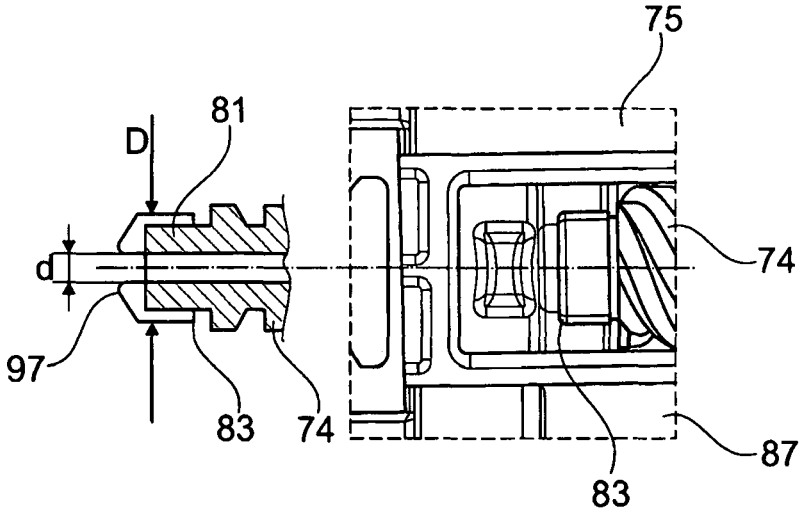
Figure 14:
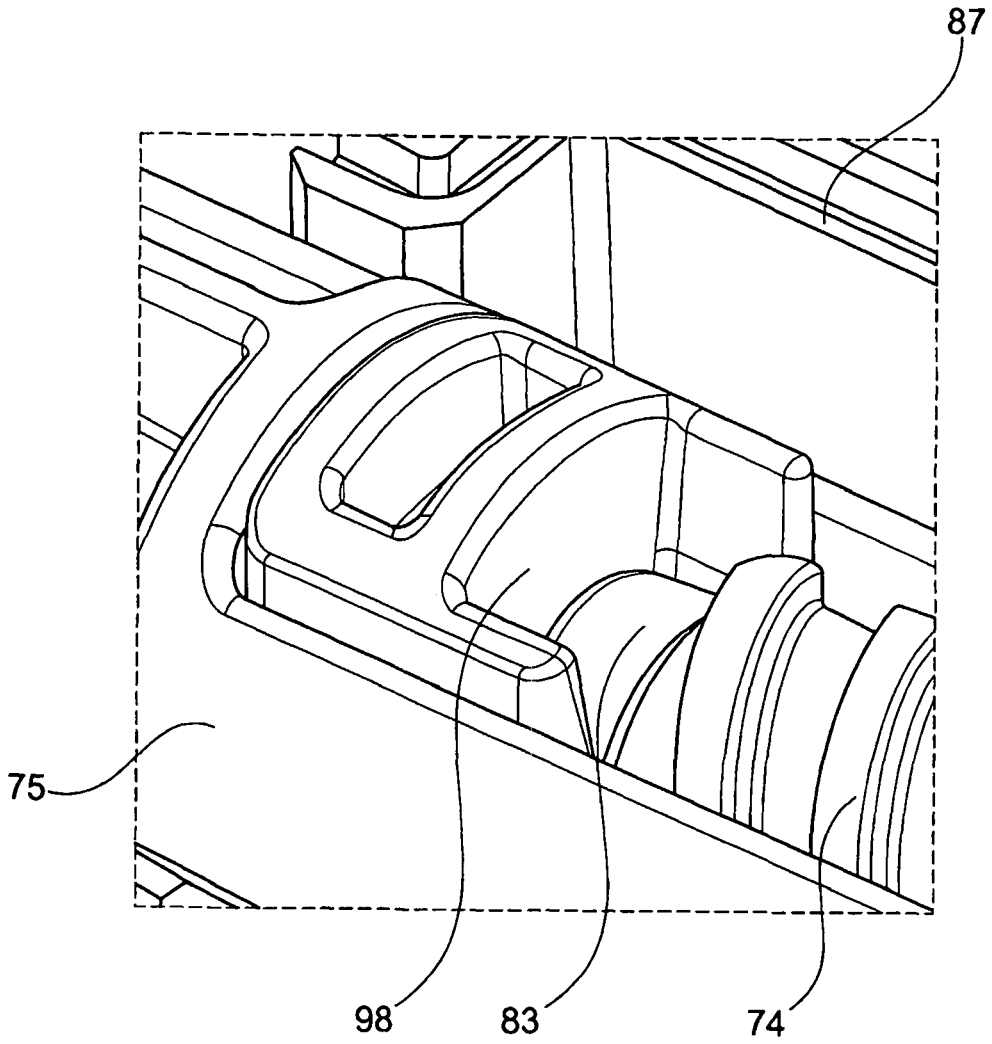

FIG. 10 a three-dimensional view of a actuator with an electric drive and a spindle drive inserted into a housing shell for an actuating means, FIG. 11 a section along line II-II from FIG. 1 with a spindle drive partially inserted in the housing, FIG. 12 a view from the direction of the arrow III in FIG. 1 towards the actuator with a transmission inserted into the housing shell with spindle drive, FIG. 13 a detailed view of a bearing sleeve on an axial end of a spindle in an opening of the actuating means, and FIG. 14 another view of a bearing sleeve on an axial end of the spindle with a contact surface for the bearing sleeve in a mounted state of the actuator.

In FIG. 1, a top view of a locking device 1 is reproduced in a basic illustration and in a partial sectional view. The locking device 1 has a lock 2, a functional unit 3, an actuating lever 4 and a two-part Bowden cable 5, 6. On the inside of the lock 7, a lever 8 is swivelably accommodated around an axis 9. Lever 8 can be swiveled around axis 9 using a Bowden cable core 10, as basically illustrated with the dot-dashed line illustrated lever 8'.

In order to actuate the Bowden cable core 10, an actuating lever 11 can be actuated, for example, inside a motor vehicle and can, for example, be swiveled. If the actuating lever 11 is actuated, the actuating lever 11 can reach the actuation position 11'.

Functional unit 3 has an electric motor 12, which can be contacted and controlled via the plug socket 13. The electric motor 12 is part of an electric drive 14, with which a spindle 16 can be driven via a worm transmission 15. A slider 17 is arranged on the spindle, with the slider 17 longitudinally accommodated by means of the electric drive 14. The Bowden cable cover 18 can be moved by means of the slider 17, so that a relative movement between the Bowden cable core 10 and the Bowden cable cover 18 can be achieved by means of the slider 17. To create the relative movement between the Bowden cable cover 18 and the Bowden cable core 10, the slider is moved towards lock 2, namely in the direction of arrow P1.

A brake lever 21 is swivelably arranged around an axis 20 on the inside 19 of the functional unit 3. The brake lever 21 has a contact surface 22 at one end, which can be made to engage with the slider 17. The slider 17 has in turn a control contour 23 which cooperates with the contact surface 22. The slider 17, and particularly the control contour 23, engage with the contact surface 22 if the slider 17 is moved by the electric drive 14 towards the arrow P2, whereby the engagement situation between the slider and the brake lever 21 is reproduced in FIG. 1. The braking situation or braking position for the Bowden cable core 10 is thus reproduced.

At one of the ends of the brake lever 21 opposite the contact surface 22, a braking surface 24 is arranged, which can be made to engage directly or indirectly with the Bowden cable core 10, for example, by means of a friction lining. Here, the braking surface 24 interacts with a counter bearing 25 which is formed, for example, from the housing 26 of the functional unit 3.

If FIG. 1 illustrates the braking situation in which the Bowden cable core 10 can be braked by means of the functional unit 3, it goes without saying that if the slider 17 is moved towards arrow P1, the brake lever 21 is disengaged from the Bowden cable core 10, disengaged at least insofar as the Bowden cable core 10 can be freely moved in the Bowden cable cover 18. In this exemplary embodiment, the brake lever 21 can be pre-tensioned counterclockwise, for example, by means of a spring. It is also self-evident that if the brake lever 21 is disengaged from the Bowden cable core, the Bowden cable cover 18 is also not pre-tensioned, that is, the lever 8 as well as the actuating lever 11 are then in an initial position. Thus, from this initial position, either the lever 8 can be actuated by actuating the slider 17 towards the arrow P1 or the brake lever 21 can be actuated by moving the slider towards the arrow P2. The brake lever 21 can be activated, for example, by a sensor in the motor vehicle, which, for example, detects an impediment in the vicinity of the motor vehicle. The braking of the Bowden cable core 10 sends a haptic signal to the driver of the motor vehicle that an actuation of the actuating lever 11 may possibly lead to a collision. However, it is always possible that the brake lever 21 is only designed in such a manner that, in the event of an emergency, the actuating lever 11 can be actuated beyond the force of the brake lever 21.

A further embodiment of the functional unit 3 with an alternative braking device is reproduced as an example in FIG. 2. In this exemplary embodiment, the brake unit 27 is made up of a rocker arm 28 and, for example, a longitudinally accommodated cylindrical pin 29. The same components according to FIG. 1 are indicated by the same reference numerals. A slider 30 is stored in a movable manner in the functional unit 3, so that the Bowden cable 18 can be controlled or moved in turn. Starting from the initial position A, the slider 30 can be moved towards the arrow P1 to actuate the Bowden cable cover 18, and achieve a relative movement between the Bowden cable core 10 and the Bowden cable cover 18. Through this movement, the slider reaches the actuation position B illustrated in FIG. 2. Starting from the initial position A, the slider 30 can also be moved towards the arrow P2 to move the cylindrical pin 29 towards the rocker arm 28, in order to enable in turn a braking of the Bowden cable core 10 against the counter bearing 25. The slider 30 then reaches the braking position AB. After a braking, the slider 30 is moved to the initial position A by means of the electric drive 14. The cylindrical pin 29 is then also moved back to the initial position by means of a spring element 30, so that the rocker arm 28 releases the Bowden cable core 10.

1ST EMBODIMENT

A locking device 1 is reproduced in a basic illustration in FIG. 3. The locking device has an actuating lever 4, a Bowden cable 5.6, a functional unit 3 and a lock 2. By means of the actuating lever 4, which may be, for example, an inside actuating lever, a lever 8 can be swiveled in lock 2 via the Bowden cable core 10.

The Bowden cable 5,6 and particularly the Bowden cable cover 8, 9, are divided into two parts and consist of a first part of the Bowden cable cover 6 and a second part of the Bowden cable cover 5. The first part of the Bowden cable cover 6 is firmly accommodated on one side, for example, inside a motor vehicle door 31 and, on the other hand, firmly accommodated in the housing 26 of the functional unit 3. The second part of Bowden cable cover 5 is firmly accommodated on one side in the lock housing 13 and is held longitudinally on the opposite side in a guide 33 in the housing 26 of the functional unit 3.

The functional unit 3 has a motor 12, a worm transmission 15, a spindle transmission 16, a slider 17, a detection means 34 in the form of a microswitch and a plug socket 13 for electric contact. Stop buffers 35 for the slider 17 of the spindle transmission 38 are also evident.

If the actuating lever 11 is moved towards the arrow P2, the actuating lever 4 reaches the dotted position of the actuating lever 11 after a piston stroke H. As is evident, only a small piston stroke h is generated by the actuating lever. A detection means that is not illustrated detects the movement of the actuating lever 11, so that a control signal can be forwarded to the functional unit 3. The worm transmission is controlled by means of the electric drive 12, whereby the worm transmission 15 is designed as one piece with the spindle 16 of the spindle transmission in this exemplary embodiment. The movement of the transmission 15 results in the slider 17 being moved to the left towards the lock 2 in FIG. 3, so that a force can be exerted on the second part of the Bowden cable cover 5. Here, the slider 17 rests on the second part of the Bowden cable cover 5 and extends the relative length of the Bowden cable 5, 6 by moving the slider 17, which in turn leads to a shortening of the relative length of the ends of the Bowden cable cores 36, 37. Since the actuating lever 4 in the position shown with continuous lines fits against a fixed stop, the free end 37 of the Bowden cable core 10 is drawn into the Bowden cable 5, 6, which in turn leads to a movement of the lever 8 to the dot-dashed position. The movement of the slider 17 in the housing 26 of the functional unit 3 occurs along the guide 33, whereby the piston stroke H is available for the movement of the slider 17. The piston stroke H is much larger than the piston stroke h, so that only an initialization of the functional unit 3 has to be performed by the actuating lever 4 in order to enable the piston stroke H and thus the actuation of the lever 8. The microswitch 34 is attached to a control curve of the slider 17 and can be used to evaluate the location of the slider.

It should be noted once again that the example illustrated here only shows a slider 17, which can be moved towards the lock and thus rests on the second part of the Bowden cable cover 5, 6. If, for example, another spindle 16 is arranged on the worm gear, which is arranged in the direction of the first part of the Bowden cable cover, and if a corresponding slider 17 is also arranged there, a displacement or relative movement of the Bowden cable in relation to the Bowden cable core 10 can be enabled in both directions. This results in an advantage for the driver in that the actuating lever 4 only has to be actuated until a detection means detects the movement of the actuating lever 4 and then forwards a control signal to the functional unit.

2ND EMBODIMENT

FIG. 4 illustrates a three-dimensional view of an actuator 41 in an embodiment as an actuating means or actuating module or opening module. Here, the actuator is inserted between a Bowden cable 42, 43, where the first part 42 of a Bowden cable cover is firmly connected to the housing 44 of the actuator and the second part of the Bowden cable 43 is fixed to an actuating means 45. A Bowden cable core 46 can be freely guided through the actuator 41.

The actuator 41 has a housing 44 in which an electric motor 47, a first worm transmission 48 and a spindle drive 49 formed as one piece with the worm transmission are arranged. On the spindle 50, an actuating means 45 is arranged so that it can be linearly guided in the housing 44. The actuating means 45 interacts with the end stops 51, which restrict a movement of the actuating means 50 into the housing 44. The end stops are preferably formed as thermoplastic rubber dampers. A microswitch 52 continues to interact with the actuating means 45, whereby the microswitch 52, as well as the electric motor 47, can be controlled via a plug socket 53 and can be supplied with power.

A surrounding housing cover seal 55 is inserted into a flat surface 54 of the housing 44. A flat surface is thus available for sealing the housing and, in particular, for mounting a housing cover that is not illustrated.

The housing 44 also has an opening 56 through which the actuating means 45 can be moved out of the actuator 41. A seal 57 is arranged in a circular form surrounding the opening 56, which is connected to the housing 44 in a form-fitting, firmly bonded and/or non-positive manner.

In this embodiment, the actuator is formed as an actuating module for a Bowden cable 42, 43. If, for example, the electric drive 47 is controlled via a control signal, the actuating means 45 is actuated by the worm transmission 48 and the spindle drive 49, so that the actuating means 45 can be moved out of the position shown in FIG. 4 from the housing 44 of the actuator 41. The movement of the actuating means 45 causes the part of the Bowden cable 43 to be moved relative to the Bowden cable core 46, so that a lever or component connected to the Bowden cable core can be moved.

A detailed view of the opening 56 of the housing 44 is reproduced in FIG. 5. The illustration shows a sealing cap 58 which is connected to the housing 44 by means of a lock bar 59. The opening 56 also has accommodation openings 60, 61 for inserting the lock bar 59 into the housing 44. The actuating means 45, which is guided and accommodated in the sealing cap 58, is also evident. A ring nut 62 can also be seen on the sealing cap 58, which is used to accommodate a sealant. A bearing point of the spindle 10 is also evident. The sealing cap 58 is reproduced in the position fixed to the housing 44.

A view of the sealing cap 58 in relation to the arrangement in the housing 44 is reproduced in FIG. 6. The bars 63 which extend symmetrically to the circumference of the sealing cap 58 can be seen. The bars 63 enable the sealing cap to be manually mounted. It is also evident that the sealing cap 58 is also attached in a form-fitting manner to the housing 44. In particular, a ring bar 64 is formed on the housing, which enables a form-fitting installation of the sealing cap.

FIG. 7 illustrates a side view of the actuator 41 and a view of the plug socket 53. The actuator 41 is integrated into a Bowden cable 42, 43, whereby an imaginary first level E1 extends along the Bowden cable 42, 43. A flat surface 54 is arranged in relation to the first level E1 in a second level E2. Starting from the first part 2 of the Bowden cable, the second level E2 is arranged so that it is offset at an angle W to the first level E1. The angle W can be selected in such a manner that a contact surface can be formed for the sealing cap 58 on the housing 44.

Furthermore, the second level E2 also forms a flat surface 54 to accommodate a housing cover.

A sectional view along the line V-V from FIG. 7 is reproduced in FIG. 8. A bellows 65 is inserted into a ring nut 62 of the sealing cap 58, whereby another end 66 is inserted into a ring nut 67 of the actuating means 45. The fixing of the Bowden cable 43 in the actuating means 45 is also evident. The actuating means 45 is illustrated in a position drawn into or moved into the housing 44, so that the bellows 65 is reproduced in a contracted position.

FIG. 9 shows an assembling drawing with the actuator 41 inserted into a Bowden cable 42, 43. The position of the bellows 65 in relation to the actuator 41 is also evident.

3RD EMBODIMENT

FIG. 10 shows a three-dimensional view of an actuator 71 for a motor vehicle, with an electric drive 72, a transmission level 73, a spindle 74 formed in one piece with the transmission level 73, an actuating means 75, a Bowden cable cover 76, whereby the actuating means 75 can be mounted through an opening 77 of the housing 78 of the actuator 71. The illustration shows that the 75 is connected to the spindle 74 on the one hand, or the spindle 74 has been inserted into the actuating means 75, and the actuating means 75 is shown inserted through the opening 77 to reach the mounting position.

The electric drive 72 has a worm 79 which interacts with a worm gear 80. The worm gear 80, as part of the transmission level 73, is made of plastic and formed in one piece with the spindle 74 in this embodiment. A bearing sleeve 83, 84 is mounted in each case at the axial ends 81, 82 of the spindle 74. The actuating means 75 also has the guide means 85, 86, via which the actuating means 75 can be axially guided into the housing 78.

In the housing 78, whereby only the housing shell 87 is shown here, a recess 88 is molded, into which the bearing sleeve 84 at the axial end 82 of the spindle can be inserted.

A housing cover that is not illustrated can be placed on a mounting surface 89 and can be firmly connected to the housing shell 87 by means of a screw opening 90 or a clip connection 91. A plug socket for the electrical contact of a microswitch and the electric drive 72 are also evident.

FIG. 11 illustrates a section through the housing 78 or the housing shell 87, along the line II-II of FIG. 10. The illustrated section along line L passes through the axial center of the spindle 74, whereby the line L reflects the location of a Bowden cable core inside the actuator 71. A Bowden cable core that stretches along line L can be freely moved through the actuator 71 by the actuator 71 in the illustrated embodiment. A Bowden cable can be fixed by means of a press fit, for example, in the extension 84 of the housing shell 87.

In order to reach the mounting position of the spindle 74, the spindle must be slid in towards the arrow P3 in the recess 88 of the housing shell 87. The spindle 74 reaches its final mounting position only when the contact surface 95 reaches the axial end of the recess 88. In the mounting position, the bearing sleeve sits fully in the recess 78, whereby the bearing sleeve arrives axially against the contract surface 95. That the spindle 74 has not yet reached its final mounting position can also be seen from the fact that the worm gear 80 is not yet located centrally above the worm 79.

FIG. 12 illustrates a view from the direction of the arrow III towards the housing shell 87 with a spindle or worm gear 80 located in the mounting position. The mounting position or the reaching of the mounting position can also be seen from the fact that the actuating means 75 fits against the end stops 96 in the housing shell 87. The axial end 82 of the spindle 74 is inserted or fully accommodated in the recess 78 of the housing shell 77.

The mounting position of the actuating means 75 in the housing shell is reproduced in turn in FIG. 13. In addition, FIG. 13 shows a schematic section through the axial end 81 of the spindle 74 with a schematically illustrated embodiment of the bearing sleeve 83. The bearing sleeve 83 entirely encloses the axial end 81 of the spindle 74, but has a conical extension at the axial end, which ends in a small diameter d. Here, the diameter d is less than the extensive diameter D of the bearing sleeve 83 in the area of the spindle end 81. It is through this bearing sleeve 83, which also has a pointed form, that the bearing sleeve 83 only comes in contact with the small diameter d on the contact surface of the housing. This offers the advantage that lower friction values have to be overcome, and thus the spindle 74 can be easily stored in the housing 78 of the actuator 71.

The bearing sleeve 83 in its mounting position in the actuator 71 is reproduced in FIG. 14. For the fixing or final storage of the spindle 74 in the housing 78, the bearing sleeve 83 is fixed in the actuator 71 by means of a housing cover that is not illustrated. Here, the pointed end 97 of the bearing sleeve 83 comes in contact with the contact surface 98. Due to the inventive accommodation of the spindle 74 in the actuator, a high level of operational safety as well as a long service life and ease of movement of the spindle can be realized.

1 LIST OF REFERENCE NUMERALS FOR FIGS. 1 TO 3

2 Lock
3 Functional unit
4 Actuating lever
5, 6 Bowden cable
7 Lock interior
8, 8' Lever
9 Axis
10 Bowden cable core
11, 11' Actuating lever
12 Electric motor

13 Plug socket
14 Electric drive
15 Worm transmission
16 Spindle
17, 30 Slider
18 Bowden cable cover
19 Functional unit interior
20 Axis
21 Brake lever
22 Contact surface
23 Control contour
24 Braking surface
25 Counter bearing
26 Housing
27 Brake unit
28 Rocker arm
29 Cylindrical pin
30 Spring
31 Motor vehicle door
32 Lock housing
33 Guide
34 Detection means
35 Stop buffers
36, 37 Ends of the Bowden cable core
38 Spindle transmission
P1, P2 Arrow
A Initial position
B Actuation position
AB Braking position
h, H Hub

LIST OF REFERENCE NUMERALS FOR FIGS. 4 TO 9

41 Actuator
42, 43 Bowden cable
44 Housing
45 Actuator
46 Bowden cable core
47 Electric motor
48 Worm transmission
49 Spindle drive
50 Spindle
51 End stops
52 Microswitch
53 Plug socket
54 Flat surface
55 Housing cover seal
56 Opening
57 Seal
58 Sealing cap
59 Lock bar
60, 61 Accommodation openings
62 Ring nut
63 Bars
64 Ring bar
65 Bellows
66 End of the bellows
67 Ring bar
E1 First level
E2 Second level
W Angle

LIST OF REFERENCE NUMERALS FOR FIGS. 10 TO 14

71 Actuator
72 Electric drive
73 Transmission level
74 Spindle
75 Actuating means
76 Bowden cable cover
77 Opening
78 Housing
79 Worm
80 Worm gear
81, 82 Axial end
83, 84 Bearing sleeve
85, 86 Guide means
87 Housing shell
88 Recess
89 Mounting surface
90 Screw opening
91 Clip connection
92 Plug socket
93 Microswitch
94 Extension
95, 98 Contact surface
96 End stops
97 Pointed end
P3 Arrow
L Line
d, D Diameter

The invention claimed is:

1. An actuator for a motor vehicle for actuating a locking device, the actuator comprising:

a housing having a housing shell and at least one housing cover, and an electric drive for moving a movable actuator in and out of the housing, wherein the movable actuator is movable by a spindle during actuation of the locking device, wherein at least one bearing sleeve provides a bearing surface for the spindle and is slidable into a recess of the housing, and the at least one bearing sleeve receives and entirely encloses an axial end of the spindle; and wherein the spindle has two bearing sleeves in the housing.

2. The actuator according to claim 1, wherein the at least one bearing sleeve is attachable to the spindle in a torsion-resistant manner.

3. The actuator according to claim 1, wherein the at least one bearing sleeve is made of a material that has a higher strength than a material of the spindle and/or a material of the housing.

4. The actuator according to claim 1, wherein the at least one bearing sleeve is formed from a metallic material.

5. The actuator according to claim 1, wherein the at least one bearing sleeve has at least a tapering diameter and the bearing sleeve only contacts the housing at a small diameter end of the tapering diameter of the at least one bearing sleeve.

6. The actuator according to claim 1, wherein the at least one bearing sleeve tapers in diameter in an axial direction of the spindle towards a contact area of the spindle in the housing.

7. The actuator according to claim 1, wherein the at least one bearing sleeve is formed from a first cylindrical area across the spindle and a second area that tapers in diameter.

8. The actuator according to claim 1, wherein the spindle and the at least one bearing sleeve have a passage opening for a Bowden cable core.

9. The actuator according to claim 1 further comprising a spindle drive, wherein the spindle reaches a final mounting position when a contact area of the spindle reaches an axial end of the recess.

10. An actuator for a motor vehicle for actuating a locking device, the actuator comprising:

a housing having a housing shell and at least one housing cover, and an electric drive for moving a movable actuator in and out of the housing, wherein the movable actuator is movable by a spindle during actuation of the locking device, wherein at least one bearing sleeve provides a bearing surface for the spindle and is slidable into a recess of the housing, and the at least one bearing sleeve receives and entirely encloses an axial end of the spindle; and wherein the at least one bearing sleeve tapers in diameter in an axial direction of the spindle towards a contact area of the spindle in the housing.

11. An actuator for a motor vehicle for actuating a locking device, the actuator comprising:

a housing having a housing shell and at least one housing cover, and an electric drive for moving a movable actuator in and out of the housing, wherein the movable actuator is movable by a spindle during actuation of the locking device, wherein at least one bearing sleeve provides a bearing surface for the spindle and is slidable into a recess of the housing, and the at least one bearing sleeve receives and entirely encloses an axial end of the spindle; and wherein the spindle and the at least one bearing sleeve have a passage opening for a Bowden cable core.

* * * * *